US006317934B1

(12) United States Patent
Hiroki et al.

(10) Patent No.: US 6,317,934 B1
(45) Date of Patent: Nov. 20, 2001

(54) FLEXIBLE CIRCULAR LINKING MEANS

(75) Inventors: Toyohisa Hiroki, Tokyo; Tadashi Suzuki, Saitama-ken, both of (JP)

(73) Assignee: Toska Co., Ltd., Tokyo (JP)

( * ) Notice: Subject to any disclaimer, the term of this patent is extended or adjusted under 35 U.S.C. 154(b) by 0 days.

(21) Appl. No.: 09/474,098

(22) Filed: Dec. 29, 1999

(51) Int. Cl.[7] ..... B65D 63/10
(52) U.S. Cl. ..... 24/16 PB
(58) Field of Search ..... 24/16 PB, 16 R, 24/17 AP, 17 A, 30.5 P; 248/74.3

(56) References Cited

U.S. PATENT DOCUMENTS 4,001,923 * 1/1977 Frankel et al. .
4,024,607 * 5/1977 Rosenberg et al. .
4,184,232 * 1/1980 Marosy .
4,240,183 12/1980 Sumimoto et al. .
4,520,537 * 6/1985 Valikov .
4,534,090 * 8/1985 Skobel .
4,543,695 * 10/1985 Dorsey .
4,651,390 * 3/1987 Skobel .
4,680,836 7/1987 Wisecup .
4,854,014 * 8/1989 Ueno .
5,893,198 * 4/1999 DeCotis .
6,073,317 * 6/2000 Barison .
6,076,194 * 6/2000 Purkett .
6,146,049 * 11/2000 Faris .

* cited by examiner

*Primary Examiner*—James R. Brittain
(74) *Attorney, Agent, or Firm*—Arent Fox Kintner Plotkin & Kahn

(57) ABSTRACT

A highly flexible annular linking means is formed by jointly connecting by a chain-like member between the first ringpart of a plastic male engagement part and the second ring part of a female engagement part.

With this highly flexible annular linking means, a loop of chain-like member can be easily formed for attaching tags onto clothing, etc. An ornamentally effect of the chain-like member will give users high quality feeling. Further, undrawable plastic materials also become available for production of these annular linking means.

5 Claims, 2 Drawing Sheets

FLEXIBLE CIRCULAR LINKING MEANS

BACKGROUND OF THE INVENTION

The present invention relates to improvements in annular linking means for attaching and sealing price tags, quality tags etc. onto clothing or others.

Conventional means for attaching price tags, quality tags etc. onto clothing for shopwindow display is provided by, as shown in FIG. 7, passing a thread 91 through the hole 9*a* of a tag 9 to form a thread loop 92, subsequently passing the loop 92 through the buttonhole 8*a* of an article 8, and finally fastening the tag 9 by passing it through the loop 92.

This means of fastening the tag 9 with a thread 91, however, has drawbacks that the thread 91 when got twisted often requires painstaking for unfastening work of the tag 9 from the thread 91 and also that, visually, the loosely hanging tag has no ornamental appeal.

Another proposal for means of attaching part of merging piece (attaching gun) to clothing or others includes a method, wherein, as illustrated in FIG. 8, a solidly molded plastic merging piece (tag fastener) 95 consisting of a head part 96, a filament part (line-like part) 97, and a lateral bar part 98 fixed in a T-shape at the end of the filament is driven at one touch into the cloth 8 of a clothing by using a tag fastener driver (or driving gun).

This tag fastener 95 method, however, has an intrinsic problem of requiring a driving gun having a hollow needle at its tip, when tag 95 is attached onto the clothing 8 or others. Further it has a drawback that is relatively harmless with thicker cloths, but presents a significant problem with a thin and delicate cloth made by fine filaments such as high quality clothing and ladies'underwear by causing following damages.

Firstly, as the attaching process inevitably accompanies piercing the clothing with a hollow needle, it gives a damage to the cloth 8. Secondly, pulling the tag 9 causes the lateral bar part 98 at the end of tag fastener 95 to damage the cloth 8 of the clothing. Thirdly, a gap in the mesh of the cloth 8 will develop to a damage of the cloth during display.

While the above-described problems are caused when attaching the tag, there also are problems when detaching the tag 9 from this tag fastener 95.

Namely, when the filament part 97 is cut apart to detach the tag 95, a T-shaped part including the lateral bar part 98 may be left within the article, causing a damage to its cloth. Finding out to remove this tiny part for disposal is another trouble.

Still another widely used tag attaching means is made of plastics, wherein a male and a female engagement parts are connected by a drawn filament part.

For this production, however, plastics need to be drawn to form a filament part, which requires a drawing process to be added to the production process, bringing up the problem of a production cost increase. Further problem is that while the process is only applicable for drawable plastics such as nylon and polyester which are opaque, such attractively transparent plasitcs as methacrylics and polystyrene are not available for it although they are strong enough.

Moreover, when the male and female parts are engaged, the filament part having a similar rigidity with a drawn fishing line forms a protruding curve on the surface of the tagged article. This curved filament looks ugly, and also prevents stowing an article above another. Due to the above-mentioned problems, the drawn filament attaching means is not suited for relatively thin high quality clothing such as silk goods.

Besides, because the filament part is as rigid as a fishing line, it keeps tags apart from the article cloth, without making any apparent distinctions between high quality and low quality articles. As a result there has been a problem from a display aspect that an image lacking in high quality has little appeal to consumers. From this aspect it is needed that an annular linking means that has an attractive appearance similar to quality-impression of a necklace, a nice touch, and an easy-workablity.

SUMMARY OF THE INVENTION

It is an object of this invention to provide an annular linking means which uses a chain-like member and is able to form a loop simply by utilizing the flexibility of the chain-like member.

It is another object of this invention to provide an annular linking means which, when used for attaching tags, etc. to clothing, is able to present a high quality impression of the clothing by utilizing the ornamental effect of a chain-like member.

It is still another object of this invention to provide a highly flexible annular linking means which is able to use even undrawable plastic materials as long as they are moldable.

The highly flexible annular linking means is constituted by a first ring part having a male engagement part, a second ring part having a female engagement part to be engaged with the male engagement part, and a linking member jointly linking the first ring part and the second ring part, wherein the linking member is formed from a chain-like member.

By this constitution, an improved operational efficiency, an improved ornamental effect, increased availability of materials, and simplified and cost-reduced production are achieved.

Namely, the highly flexible annular linking means of this invention, enables to easily form a highly flexible loop made by an attractive chain-like member by passing the male engaging part through the hole of a tag, etc. and subsequently inserting the male part at the tip into the fitting part.

Thus, with the help of this chain-like member loop, tags can be easily and securely attached to clothing.

This attractive chain-like member that forms a loop, when flatly laid upon the cloth of a displayed article, gives a comfortable fitting impression as it appears to stick to the cloth without protruding therefrom. Namely its necklace-like fitness to the article gives users a soft and gentle impression of it. Further, an ornamental effect may be generated by simply putting the chain-like member curvedly.

Therefore, aquality image of the displayed article attained by using this highly flexible annular linking means helps to enhance sales effect by stimulating consumers'purchasing mind.

Further, in the above described highly annular linking means, the first and second ring parts, and the chain-like member may be arranged to be formed of plastics, or alternatively, the chain-like member may be arranged to be formed of metal, while the first and second ring parts being formed of plastics. By those arrangements, diversified availability and enhanced ornamentality of the annular linking means can be attained.

The elimination of drawn filament part, in particular, enables use of a much wider selection of plastic materials including not only those extendable plastics as polyamide (nylon, etc., PA) and polypropylene (PP), but also such plastics as methacryls (PMMA) and polystyrene (PS) that have attractive appearance in transparency, luster, colorability, etc. with excellent strength and durability.

Further, as the elimination of drawn filament part also eliminates the drawing process, leaving only the molding process, total production process becomes very simple and thus the production cost can reduced.

Still further, a higher workability is accomplished by changing the sizes of the first and second rings to sizes that allow insertion thereof into the hole of a tag to be fastened by the annular linking means.

A detailed description on the male and female engagement parts follows next.

In the above described highly flexible annular linking means, the male engagement part is comprised to have a head part which is supported by a cylindrical base part via a neck part and has an expandable and contractible merging part at its rear, and the female engagement part is comprised to have a fitting hole which is formed within a tubular frame for fitting the male engagement part and has at its approximately middle point an annular protrusion which allows forward passing the merging part, but prevents its backward movement.

Further, in the above described highly flexible annular linking means, the male engagement part may be comprised to have a head part, a center body connected to the head part, and side wall parts located at both sides of the center body, with the side walls connecting to the center body at one end and having a protruding part on its outer surface, wherein, as the protruding part passes through the female engagement part, a pressing force onto the protruding part works to elastically bend the other end toward the center body causing a radial contraction of the protruding part, and the female engagement part may be comprised to have a fitting hole which is formed within a tubular frame for fitting the male engagement part and has at its approximately middle point an annular protrusion which allows forward passing of the merging part, but prevents its backward movement.

Still further, for easiness of radial contraction of the protruding part, a center groove may be formed at the end of the center body to present a W-shaped section formed by the center body and the side wall parts.

By adopting the male and female engagement parts of above constitution, a highly flexible annular linking means can be easily manufactured.

The above and other objects, features and advantages of the present invention will be apparent from the following detailed description with reference to the accompanying drawings. However, these drawings are intended to illustrate the invention and are not to be construed to limit the scope of the invention.

DETAILED DESCRIPTION OF THE INVENTION

Embodiments of the highly flexible annular linking means according to the present invention will be described below with reference to the drawings.

Figure 1:
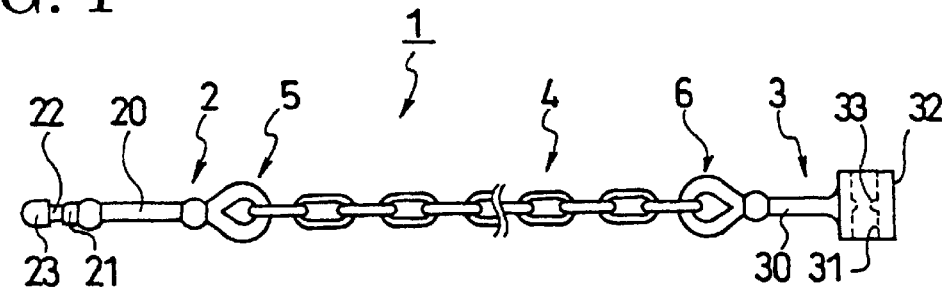
FIG. 1 is a front elevation of a highly flexible annular linking means of the present invention.
Figure 2:
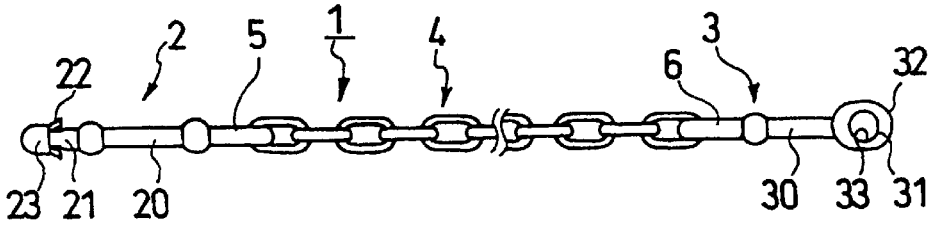
FIG. 2 is a plan view of FIG. 1.

As shown in FIGS. 1 and 2, the highly flexible annular linking means 1 of the present invention comprises in a form that a first ring part 5 of a plastic male engagement part 2 and a second ring part 6 of a female engagement part 3 which engages with the male engagement part 2 are jointly connected via a chain-like member 4.

This chain-like member 4 is the part which is formed by a combination of small rings and renders flexibility to a loop formed by the annular linking means 1.

This ring can be of any shape including oval, round or rectangular, without limiting to any specific shape. Further, while the chain-like member 4 is normally made of plastics, it can also be made of metal. Preferably, an attractively looking material should be selected to match the patterns of the articles to be tagged, tags, etc.

Figure 3:
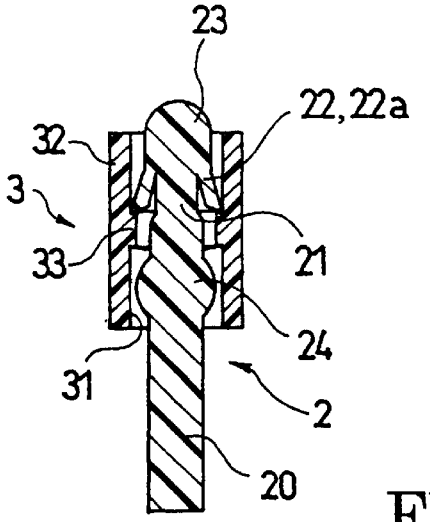
FIG. 3 is a fragmentary sectional view showing the engagement of a male engagement part and female engagement part of the present invention.

Further, as shown in FIGS. 1 to 3, the male engagement part 2 is formed by a cylindrical base 20 linking to the first ring part 5 and a head part 23 provided via a neck part 21. At the neck part 21 side of this head part 23, there is provided a self-locking merging part 22 which is expandable and contractible. This merging part has a merging piece 22*a* which is formed to elastically expand and contractible so as be able to radially shrink when passing through the annular protrusion part 33 formed at approximately middle point within a fitting hole 31 and to expand after passing the part.

Still further, a stopper part 24 is provided onto the base part 20 at a rear point of the trailing edge of the merging piece 22*a* by a distance greater than the thickness of annular protrusion 33. This stopper part 24 is formed to have a diameter that is greater than the pierced hole at the annular protrusion part 33 and smaller than the fitting hole 31.

Yet further, the fitting part 3 is formed to have a frame part 32 having a fitting hole 31 for a head part 23 to fit in, a cylindrical base part 30 connecting to the frame 32, and a second ring part 6 connecting to the base part 30. Moreover, as described above, the fitting hole 31 has an annular protrusion 33 internally protruding at its approximately middle point.

Another embodiment of the fitting part 22 of the male engagement part 2 will be described below.

Figure 4:
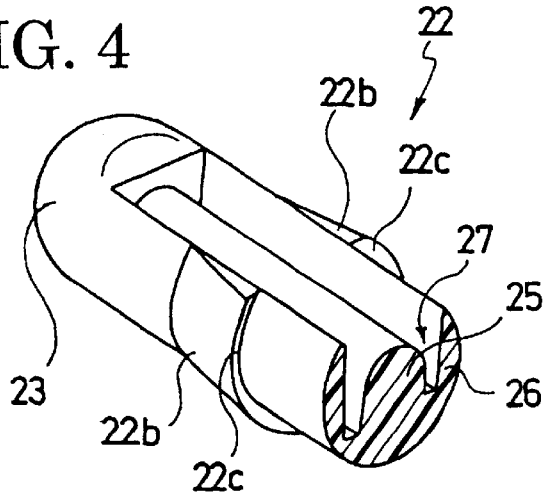
FIG. 4 is a partly sectional view of the second embodiment of the engagement part of the present invention.
Figure 5:
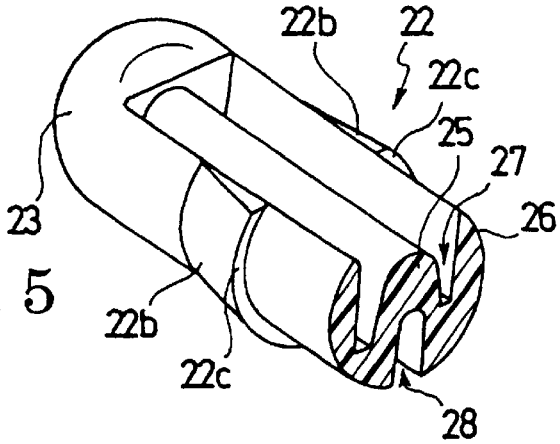
FIG. 5 is a partly sectional view of the third embodiment of the engaging protrusion of the present invention.
Figure 6:
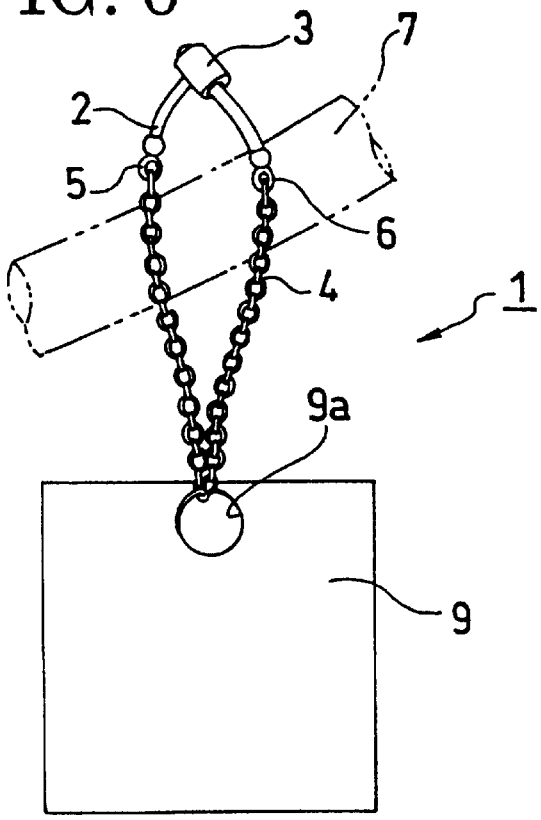
FIG. 6 illustrates the state of use of the highly flexible annular linking means of present invention.
Figure 7:
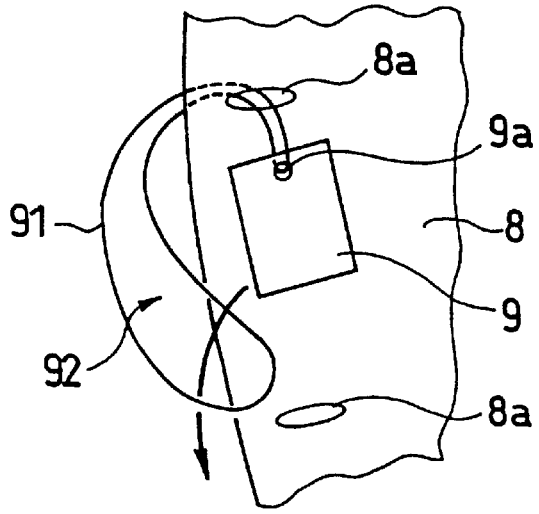
FIG. 7 PRIOR ART
FIG. 7 illustrates the conventional method of attaching a tag by using a thread loop.
Figure 8:
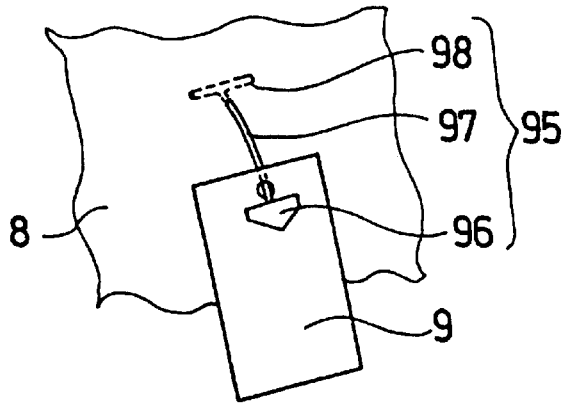
FIG. 8 PRIOR ART
FIG. 8 illustrates a state of attachment of the tag using a plastic merging piece (tag fastener) according to conventional art.

It should be noted, here, that the fitting part 22 to be provided to the male engaging part 2 may have constitutions shown in FIGS. 4 and 5. Namely, grooves 27 are provided inside of the protruding part 22*b* of the fitting part 22 to form a center body 25 and side wall parts 26. The fitting part 22 of FIG. 5 is provided with a center groove 28 at its bottom side in the drawing so as the bottom part to be elastically deformable to a smaller diameter.

With this constitution, as the protruding part 22*b* begins to pass the annular protrusion part 33 within the fitting hole 31, the side wall parts 26, being pressed toward the center body 25 and getting smaller in diameter, make way for the protruding part 22*b* to pass through. Further, after the part has passed through, the original diameter is recovered by its elasticity and a trailing edge 22*c* of the protruding part 22*b* prevents backward movement, thereby achieving a stiffer engagement.

The chain-like member 4 connecting the male engagement part 2 and the female engagement part 3 should have a proper and not too long length for attaching to articles or tags, depending on the sizes of tags, the articles to be tagged and uses thereof. The length may be, for example, 60 to 200 mm and preferably about 100 mm.

The method of use of this highly flexible annular linking means will be described in the following.

As shown in FIG. 5, a loop made of chain-like member 4 is formed by passing the male engagement part 2 and chain-like member 4 through the hole 9*a* of tag 9, thereby supporting the tag 9 by the chain-like member 4, subsequently passing them through an article, such as the handle of a purse, and finally passing the tip male engagement part through the fitting hole 31, thereby completing fitting at the fitting part 3.

Namely, the tag 9 is attached to an article, etc. by utilizing the loop of chain-like member 4.

Therefore, the highly flexible annular linking means of the present invention has following advantages.

Firstly, the high flexibility of the chain-like member which constitutes the main body of the loop enables to form a loop easily.

This chain-like member 4 that forms a loop, when flatly laid, fits softly upon the displayed article 9, thereby giving a comfortable fitting impression. The soft and gentle touch presented to the article gives customers a high quality feeling about it. Further, light reflections caused by the rings of the chain-like member 4 and quality touch of the chain-like member 4 generates an even higher image to the customers.

Further, as the drawn filament part is not used, the drawing process can be eliminated. It, therefore, makes possible to use those plastics that are undrawable, yet attractive in appearance such as transparency, luster and colorability and excellent in strength and durability, thereby improving the appearance, strength, costs etc. of the parts made by plastics.

What is claimed is:

1. A highly flexible annular linking means for attaching tags comprising:

a first ring part (5) having a male engagement part (2);

a second ring part (6) having a female engagement part (3) to be engaged with said male engagement part (2); and a linking member (4) for jointly linking said first ring part (5) and said second ring part (6);

wherein said linking member (4) is formed from a chain-like member (4), said linking member (4), said first ring part (5) and said second ring part (6) being integrally formed from a plastic and wherein said male engagement part (2) is comprised to have a head part (23) which is supported by a cylindrical base part (20) via a neck part (21) and has an expandable and contractible merging part (22) at its rear, and said female engagement part (3) is comprised to have a fitting hole (31) which is formed within a tubular frame (32) for fitting said male engagement part (2) and has at its approximately middle point an annular protrusion (33) which allows forward passing of said merging part (22), but prevents its backward movement.

2. A highly flexible annular linking means for attaching tags according to claim 1, wherein said first ring part (5) and said second ring part (6) are operative for insertion into a hole (9*a*) of a tag (9) to be fastened by said annular linking means.

3. A highly flexible annular linking means for attaching tags comprising:

a first ring part (5) having a male engagement part (2);

a second ring part (6) having a female engagement part (3) to be engaged with said male engagement part (2); and a linking member (4) for jointly linking said first ring part (5) and said second ring part (6);

wherein said linking member (4) is formed from a chain-like member (4), said linking member (4), said first ring member (5) and said second ring member (6) being integrally formed from plastic, wherein said male engagement part (2) is comprised to have a head part (23), a center body (25) connected to said head part (23), and side wall parts (26) located at both sides of the center body (25), said side wall parts (26) being connected to said center body (25) at one end and having a protruding part (22*b*) on its outer surface, and, as said protruding part (22*b*) passes through said female engagement part (3), a pressing force onto the protruding part (22*b*) works to elastically bend the sidewall parts toward said center body (25) to cause a radial contraction of the protruding part (22*b*), and wherein said female engagement part (3) is comprised to have a fitting hole (31) which is formed within a tubular frame (32) for fitting said male engagement part (2) and has at its approximately middle point an annular protrusion (33) which allows forward passing of said protruding part (22*b*), but prevents its backward movement.

4. A highly flexible annular linking means for attaching tags according to claim 3, wherein said first ring part (5) and said second ring part (6) are operative for insertion into a hole (9*a*) of a tag (9) to be fastened by said annular linking means.

5. A highly flexible annular linking means for attaching tags according to claim 3, wherein a center groove (28) is formed at said end of said center body (25) to present a W-shaped section formed by said center body (25) and said side wall parts (26).

* * * * *